US007748066B2

(12) United States Patent
Gladney

(10) Patent No.: US 7,748,066 B2
(45) Date of Patent: Jul. 6, 2010

(54) MATTRESS CENTER RIDGE COMPENSATOR

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 950 days.

(21) Appl. No.: 10/671,903

(22) Filed: Sep. 26, 2003

(65) Prior Publication Data

US 2005/0066446 A1 Mar. 31, 2005

(51) Int. Cl.
*A47C 27/00* (2006.01)

(52) U.S. Cl. ..... 5/935; 5/936; 5/710; 5/721; 5/727

(58) Field of Classification Search ..... 5/716–721, 5/710, 711, 713, 935, 936, 727, 728, 739
See application file for complete search history.

(56) References Cited

U.S. PATENT DOCUMENTS 2,345,421 A * 3/1944 Perry ..... 5/706
2,859,505 A * 11/1958 Jarvis ..... 5/710
3,516,901 A * 6/1970 Wolk et al. ..... 428/218
3,608,107 A * 9/1971 Kentor et al. ..... 5/716
4,086,675 A * 5/1978 Talbert et al. ..... 5/655.9
4,092,749 A * 6/1978 Klancnik ..... 5/267
5,077,849 A * 1/1992 Farley ..... 5/730
5,537,699 A * 7/1996 Bonaddio et al. ..... 5/739
5,579,549 A * 12/1996 Selman et al. ..... 5/721
5,704,085 A * 1/1998 Sabalaskey ..... 5/717
6,003,179 A * 12/1999 Farley ..... 5/736
6,041,459 A * 3/2000 Nunez et al. ..... 5/730

* cited by examiner

*Primary Examiner*—Sunil Singh
(74) *Attorney, Agent, or Firm*—Ropes & Gray LLP

(57) ABSTRACT

A mattress includes reduced-firmness materials along a central region thereof in order to mitigate the occurrence of a central ridge following repeated use of the mattress as a sleeping surface. An associated box spring may also, or instead, present a central region with reduced firmness. An adjustable member may be employed to controllably compensate for the development of a central ridge.

20 Claims, 2 Drawing Sheets

MATTRESS CENTER RIDGE COMPENSATOR

BACKGROUND OF THE INVENTION

1. Field of the Invention

The present invention relates to mattresses with center ridge compensation.

2. Description of the Related Art

A mattress center ridge is characterized by two disadvantages of conventional mattress.

First, elevation of the surface along the center ridge is greater than the elevation of surrounding areas. Materials in a two-person mattress, such as a queen or king size mattress, become compressed in the areas of the surface where people sleep. By comparison, materials along the center of the mattress remain uncompacted, and over time present an elevated surface. The center ridge is also caused, or worsened, by the manner in which people enter and exit beds. As users sit on the edges of the mattress and roll into the mattress from the sides, materials within the mattress core are continuously urged toward the mattress's center. As a result, the center of the mattress may eventually have a greater density of material than the edges.

Second, firmness at the center of the mattress may be greater than firmness across the conventional sleeping areas. This results in part from the phenomena discussed above. It is also caused by fatigue in the mattress core over repeated used. Further, box springs for large mattresses may be provided in two sections. This design may presents a rigid upper surface to the mattress along a center line where two box springs meet.

There remains a need for a mattress design that prevents or mitigates the development of a center ridge.

SUMMARY

A mattress includes reduced-firmness materials along a central region thereof in order to mitigate the occurrence of a central ridge following repeated use of the mattress as a sleeping surface. An associated box spring may also, or instead, present a central region with reduced firmness. An adjustable member may be employed to controllably compensate for the development of a central ridge.

In one aspect, the invention is a mattress including a head end, a foot end, a first side and a second side; and a center region traversing the mattress from the head end to the foot end, the center region including one or more materials that mitigate the emergence of a center ridge over repeated uses of the mattress.

The center region may be separated by an approximately equal distance from the first side and the second side. The mattress may be a queen size mattress or a king size mattress. The center region of the mattress may have a width of between about six inches and about twelve inches. The center region may have a firmness reduced by about ten percent to about thirty percent relative to other regions of the mattress. The mattress may include a quilted material over a sleeping surface thereof, the quilted material having a firmness in the center region reduced by about ten percent to about thirty percent relative to other regions of the mattress. The mattress may include an upholstery material over a sleeping surface thereof, the upholstery material having a firmness in the center region reduced by about ten percent to about thirty percent relative to other regions of the mattress. The mattress may include a core that has a firmness in the center region reduced by about ten percent to about thirty percent relative to other regions of the mattress. The core may include a plurality of open coil springs, a plurality of pocket springs, and/or foam, which may be viscoelastic foam.

In another aspect, a box spring according to the invention may be configured for use with another box spring to support a mattress, the box spring including a head end, a foot end, an outer side configured to support an edge of a mattress above the box spring, and an inner side configured to abut a second box spring beneath a center region of the mattress, the inner side having a firmness reduced by about ten percent to about thirty percent relative to the outer side.

The box spring may be used with a second box spring wherein the box spring and the second box spring may be placed side by side to present a support surface to a mattress, the support surface having a center region along the inner side of the box spring and an inner side of the second box spring with a firmness reduced by about ten percent to about thirty percent relative to the outer side of the box spring and an outer side of the second box spring. The box spring may include a core including one or more open coil springs and/or one or more pocket coil springs.

In another aspect, a mattress according to the invention may include a head end, a foot end, a first side and a second side, and a center region traversing the mattress from the head end to the foot end, the center region including one or more materials having a firmness reduced by about ten percent to about thirty percent relative to other regions of the mattress. The center region may be separated by an equal distance from the first side and the second side.

In another aspect, a mattress according to the invention may include a head end, a foot end, a first side and a second side, a center region separated from the first side and the second side and traversing the mattress from the head end to the foot end, and a compensation means for reducing a firmness of the center region by about ten percent to about thirty percent relative to other regions of the mattress.

In another aspect, there is disclosed a method for manufacturing a mattress including constructing a first region and a second region of one or more materials having a first firmness, the first region and the second region being configured to provide a sleeping surface to one or more users of the mattress, and constructing a center region between the first region and the second region, the center region being constructed of one or more materials that together have a second firmness less than the first firmness. The second firmness may be reduced by about ten percent to about thirty percent relative to the first firmness.

In another aspect, a mattress according to the principles of the invention may include a head end, a foot end, a first side and a second side; and a center region traversing the mattress from the head end to the foot end, the center region including one or more adjustable members controllable to adjust the center region in response to an emerging center ridge

BRIEF DESCRIPTION OF THE DRAWINGS

The present disclosure may be better understood and its numerous features and advantages made apparent to those skilled in the art by referencing the accompanying drawings.

DETAILED DESCRIPTION

Described herein is a mattress having a center ridge compensation system that mitigates the development of a center ridge over repeated uses of the mattress. However, it will be appreciated that the principles of the system described herein may be adapted to a wide range of applications where a cushioned surface is subjected to repetitive stresses over less than all of the surface. For example, the principles of this disclosure may be applied to automotive seats or couches where a user typically sits in certain locations. The systems described herein may also be used in padded outdoor furniture or on any other surface where a compensation system can advantageously mitigate the development of an undesired ridge over repeated uses.

Figure 1:
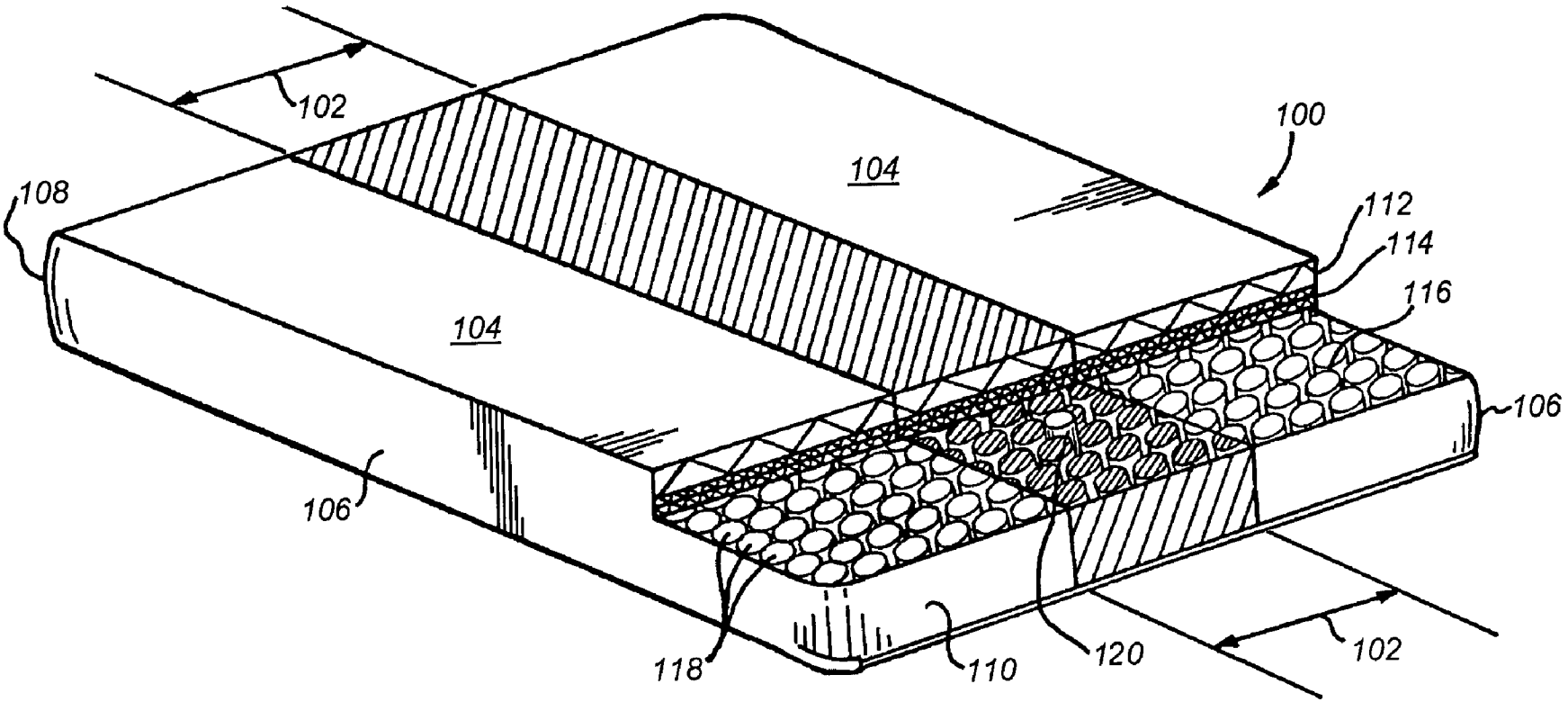
FIG. 1 shows a cutaway perspective view of a mattress with center ridge compensation.

FIG. 1 shows a cutaway perspective view of a mattress with center ridge compensation. The mattress 100 may include a center region 102 and one or more side regions 104, each abutting a side 106 of the mattress, a head end 108, and a foot end 110. The mattress 100 may include one or more quilting layers 112, one or more upholstery layers 114, a core 116 including, for example, a plurality of springs 118 to support a sleeper using the mattress, and one or more adjustable members 120.

The mattress 100 may be, for example, a queen size mattress or a king size mattress, or any other mattress of conventional or unconventional dimensions. Typically, the mattress 100 will be of a size for more than one concurrent user. As will be described in greater detail below, the mattress 100 may be of any general construction, and may employ, for example, a foam core, an open spring core, or a pocket spring core to provide a suitable sleeping surface. The mattress may be designed for use in two orientations, in which case both an upper and lower surface of the mattress will include a ridge compensation system as described herein, or the mattress may be a no-flip mattress that is designed for use in one or two orientations with a single upper surface. In this latter case, ridge compensation is only required for the single upper surface.

The center region 102 extends from the head end 108 to the foot end 110 of the mattress 100, and may be separated from the sides 106 by side regions 104. It is generally expected that users of the mattress will sleep in the side regions 104 and not in the center region 102. In certain embodiments, the center region 102 may not extend fully to the head end 108 and the foot end 110. The center region 102 may be of any suitable width, such as two inches to twelve inches, or any other width according to the size of the mattress 100 and the regions where sleepers are expected to repose. It will also be appreciated that the center region 102, while depicted as parallel to the sides 106, may vary in width along the length of the mattress 100, and may be, for example, wider near the head end 108 and the foot end 110, or narrower at the ends 108, 110 and wider between the ends 108, 110. The shape may be varied according to considerations of cost, materials, or expected regions of use of the mattress 100. It will also be appreciated that the center region 102 may be asymmetric in profile (either in width along the sleeping surface or in thickness and firmness of center ridge compensating materials), depending on the number of orientations for which the mattress 100 is intended to be used.

The one or more quilting layers 112 may include any suitable or conventional mattress quilting materials, and may be quilted in any manner to provide a desired texture or appearance to an exterior surface of the mattress 100. The one or more quilting layers 112 may have increased firmness in the center region 102 that mitigates the development of a center ridge between the side regions 104. This increased firmness may be achieved, for example, by the use of additional quilting layers in the center region 102, or the use of reinforcing materials such as plastic sheets or fibers within or between the one or more quilting layers 112, or any other suitable material or materials for increasing firmness. The relative firmness in the center region 102 and the side regions 104 may be measured using Indentation Deflection Force ("IDF") or any other suitable, objective scale used in the mattress making or cushioning arts. In one embodiment, the firmness of the one or more quilting layers 112 is ten percent to thirty percent firmer in the center region 102 than in the abutting side regions 104. The transition from the relatively firm center region 102 to the relatively less firm side regions 104 may be smooth or abrupt, according to the desired feel of the mattress and the materials used to enhance the firmness of the one or more quilting layers 112.

The one or more upholstery layers 114 may include, for example, padding, batting, waterproof or water absorbent materials, or any other suitable layers for use with the mattress 100 that may be employed for comfort, longevity, or specific functional features desired for the mattress 100. The one or more upholstery layers 114 may have increased firmness in the center region 102 that mitigates the development of a center ridge between the side regions 104. This increased firmness may be achieved, for example, by the use of additional upholstery layers in the center region 102, or the use of reinforcing materials such as plastic sheets or fibers within or between the one or more upholstery layers 114, or any other suitable material or materials for increasing firmness. The relative firmness in the center region 102 and the side regions 104 may be measured using Indentation Deflection Force ("IDF") or any other suitable, objective scale used in the mattress making or cushioning arts. In one embodiment, the firmness of the one or more upholstery layers 114 is ten percent to thirty percent firmer in the center region 102 than in the abutting side regions 104. The transition from the relatively firm center region 102 to the relatively less firm side regions 104 may be smooth or abrupt, according to the desired feel of the mattress and the materials used to enhance the firmness of the one or more upholstery layers 112.

The core 116 may be of any conventional or unconventional construction suitable for use in a sitting, sleeping, or reclining surface such as the mattress 100. Although coils 118 are depicted in the core 116 of FIG. 1, it will be appreciated that any material or materials may be used in the core 116, including open coils, pocket coils, a monolithic or composite foam (such as viscoelastic foam), fluids or gasses in one or more bladders, and so forth, or any combination of these. The core 116 may have increased firmness in the center region 102 that mitigates the development of a center ridge between the side regions 104. This increased firmness may be achieved, for example, by the use of additional springs, stiffer springs, springs that are smaller and more densely packed, firmer materials (for, e.g., foam or air bladders), and so forth. The relative firmness in the center region 102 and the side regions 104 may be measured using Indentation Deflection Force ("IDF") or any other suitable, objective scale used in the mattress making or cushioning arts. In one embodiment, the firmness of the core 116 is ten percent to thirty percent firmer in the center region 102 than in the abutting side regions 104. The transition from the relatively firm center region 102 to the relatively less firm side regions 104 may be smooth or abrupt, according to the desired feel of the mattress and the materials or techniques used to enhance the firmness of the core 116.

One or more adjustable members 120 may be provided to adjust firmness within the center region 102 or to compensate for the development of a ridge within the center region 102 as the mattress ages. The one or more adjustable members 120 may include, for example, one or more air bladders, pneumatic cylinders, or other adjustable members 120 within the center region 102 that controllably stiffen or elevate this region of the mattress, or controllably reduce the stiffness to remove an emerging center ridge. Any other type of adjustable member suitable for use within a mattress may be suitably employed, such as hydraulically adjustable devices or adjustable springs. The one or more adjustable members 120 may be placed along the center region 102 within the core 116, the quilting layers 112, and/or the upholstery layers 114. Although not depicted in FIG. 1, it will be appreciated that the adjustable members 120 may also, or instead, be placed along the side regions 104 so that the side regions 104 may be stiffened or raised in response to an emerging center ridge.

Figure 2:
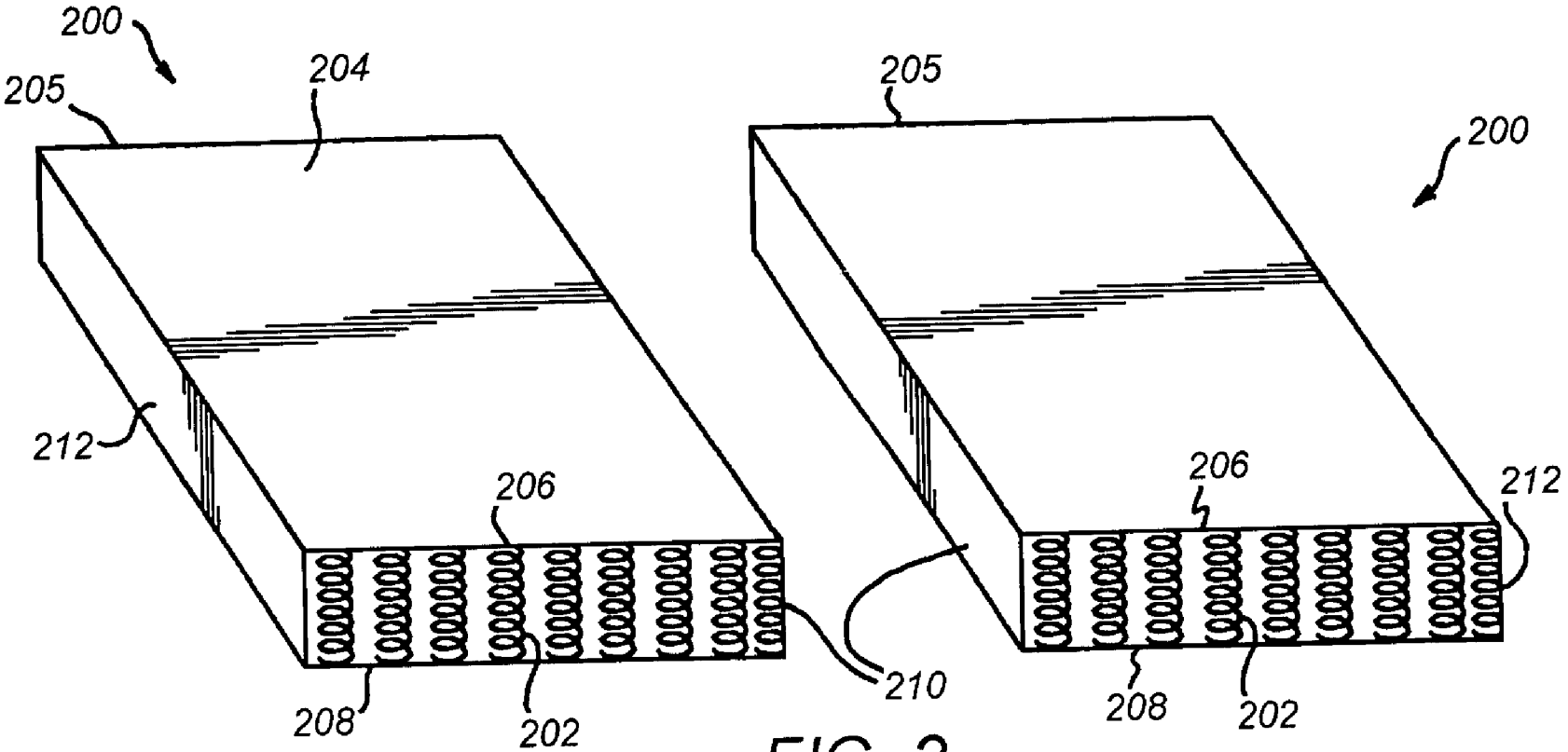
FIG. 2 shows a pair of box springs with center ridge compensation.

FIG. 2 shows a pair of box springs with center ridge compensation. The box springs 200 may be of a conventional box spring construction, and each box spring 200 may include an assembly of wire springs 202, a padded upper surface 204, a head end 205, a foot end 206, ticking (not shown), a dust cover 208, an inner side 210 and an outer side 212.

The box springs 200 may be of a size to be supported on a bed frame (not shown) that raises the box springs 200 to a desired level above the floor. The assembly of wire springs 202 may instead be any non-resilient or semi-resilient structure attached to a rigid frame (not shown) located at a bottom of the box spring 200. The padded upper surface 204 may optionally be included on a top surface of the box spring 200. The ticking 206 may encase the entire box spring 200, and may be sewn together around a periphery of the box spring 200 and/or stapled or otherwise attached to a border of the box spring 200 or the rigid frame. The dust cover 208 may be fashioned of light plastic film or a like material and applied to the underside of the rigid bottom frame to prevent accumulation of dust and other particles or debris within the box spring 200.

The inner side 210 of each box spring 200 is intended to abut an inner side 210 of another box spring 200 so that, in tandem, the box springs 200 present a surface to support a correspondingly sized mattress. The outer side 212 of each box spring 200 may be aligned below an outer edge of the mattress 100 of FIG. 1. The inner side 210 may be firmer than the outer side 220 so that ridge compensation is provided. This may be accomplished, for example, by providing stiffer guide wires or other materials along the inner side 210, or adding additional springs or supports along the inner side 210. These or other techniques may be readily adapted to provide a firmer inner side 210 for the box springs 200.

While box springs 200 may be manufactured in pairs so that each individual, rigid box spring 200 may be readily moved through doors or other openings, it is also possible to have a single box spring 200. Any of the reinforcement techniques used above may be adapted to such a box spring to provide increased firmness in an area corresponding to the center region of a mattress.

More generally, other constructions than the single or dual box springs noted above may be employed to provide a foundation for the mattress 100 of FIG. 1, and may be constructed to provide increased firmness in an area corresponding to the center region 102 of the mattress 100.

While particular embodiments of the present invention have been shown and described, it will be apparent to those skilled in the art that changes and modifications may be made without departing from the scope of the invention, and therefore, the following claims are to be interpreted in the broadest sense allowable by law.

What is claimed is:

1. A mattress comprising:
a head end;
a foot end;
a first side and a second side; and
a center region traversing the mattress from the head end to the foot end, the center region including one or more materials other than a single air bladder that mitigate the emergence of a center ridge over repeated uses of the mattress, the center region having a width of between about two inches and about twelve inches.

2. The mattress of claim 1 wherein the center region is separated by an approximately equal distance from the first side and the second side.

3. The mattress of claim 1 wherein the mattress is a king size mattress.

4. The mattress of claim 1 wherein the center region has a firmness reduced or increased relative to other regions of the mattress.

5. The mattress of claim 1 wherein the mattress includes a quilted material over a sleeping surface thereof, the quilted material having a firmness in the center region reduced or increased relative to other regions of the mattress.

6. The mattress of claim 1 wherein the mattress includes an upholstery material over a sleeping surface thereof, the upholstery material having a firmness in the center region reduced or increased relative to other regions of the mattress.

7. The mattress of claim 1 wherein the mattress includes a core, the core having a firmness in the center region reduced or increased relative to other regions of the mattress.

8. The mattress of claim 7 wherein the core includes a plurality of open coil springs.

9. The mattress of claim 7 wherein the core includes a plurality of pocket coil springs.

10. The mattress of claim 7 wherein the core includes foam.

11. The mattress of claim 10 wherein the foam is viscoelastic foam.

12. The mattress of claim 1 wherein the one or more materials that mitigate the emergence of a center ridge are included in a upper surface of the mattress.

13. The mattress of claim 1 wherein the mattress is at least the size of a queen size mattress.

14. A mattress comprising:
a head end;
a foot end;
a first side and a second side;
a center region traversing the mattress from the head end to the foot end, the center region including one or more materials other than a single air bladder having a firmness reduced or increased relative to other regions of the mattress, the center region having a width of between about two inches and about twelve inches.

15. The mattress of claim 14 wherein the center region is separated by an equal distance from the first side and the second side.

16. The mattress of claim 14 wherein the one or more materials having a firmness reduced or increased relative to other regions of the mattress are included in a upper surface of the mattress.

17. A mattress comprising:
a head end;
a foot end;
a first side and a second side;
a center region separated from the first side and the second side and traversing the mattress from the head end to the foot end, the center region having a width of between about two inches and about twelve inches; and
a compensation means other than adjusting the inflation of a single air bladder for reducing or increasing a firmness of the center region relative to other regions of the mattress.

18. The mattress of claim 17 wherein the compensation means of the center region is included in a upper surface of the mattress.

19. A mattress comprising:

a head end;

a foot end;

a first side and a second and a center region traversing the mattress from the head end to the foot end, the center region including one or more adjustable members other than a single air bladder controllable to adjust the center region in response to an emerging center ridge, the center region having a width of between about two inches and about twelve inches.

20. The mattress of claim 19 wherein the one or more adjustable members are included in a upper surface of the mattress.

* * * * *